US007324080B1

(12) United States Patent
Hu et al.

(10) Patent No.: US 7,324,080 B1
(45) Date of Patent: Jan. 29, 2008

(54) BACKLIGHTING IN LIQUID CRYSTAL FLAT PANEL DISPLAY

(75) Inventors: Darwin Hu, San Jose, CA (US); Kebin Li, Fremont, CA (US)

(73) Assignee: Sysview Technology, Inc.

( * ) Notice: Subject to any disclaimer, the term of this patent is extended or adjusted under 35 U.S.C. 154(b) by 485 days.

(21) Appl. No.: 11/003,317

(22) Filed: Dec. 3, 2004

(51) Int. Cl.
*G09G 3/36* (2006.01)

(52) U.S. Cl. ..... 345/102; 345/87

(58) Field of Classification Search ..... 345/87–102, 345/204; 315/291; 349/71; 362/30, 84, 362/230, 246, 240, 800
See application file for complete search history.

(56) References Cited

U.S. PATENT DOCUMENTS 7,052,152 B2 * 5/2006 Harbers et al. ..... 362/30
2002/0113192 A1 * 8/2002 Antila ..... 250/205
2005/0259439 A1 * 11/2005 Cull et al. ..... 362/612
2006/0007097 A1 * 1/2006 Ichikawa ..... 345/102
2006/0038511 A1 * 2/2006 Tagawa ..... 315/291
2006/0049781 A1 * 3/2006 Lee et al. ..... 315/312

* cited by examiner

*Primary Examiner*—Nitin I. Patel
(74) *Attorney, Agent, or Firm*—Joe Zheng

(57) ABSTRACT

Techniques for providing backlight techniques in liquid crystal flat panel displays are disclosed. According to one aspect of the techniques, the source to backlight a liquid crystal panel includes a plurality of light emitting diodes that are in at least three colors. The exact colors of the light emitting diodes are chosen to cover or exceed a full spectrum of color reproductions in accordance with a television standard (e.g., NTSC or PAL) in addition to a balanced white. In one embodiment, a set of control signals is configured to ensure that the light emitting diodes provide desired and consistent backlighting to a LCD panel. One of the control signals adaptive to a scene or content of a scene causes the backlighting to change accordingly or drastically to create artistic effects required or desired in the scene.

19 Claims, 8 Drawing Sheets

BACKLIGHTING IN LIQUID CRYSTAL FLAT PANEL DISPLAY

BACKGROUND OF THE INVENTION

1. Field of the Invention

The present invention is related to the area of display devices. More particularly, the present invention is related to enhanced backlight techniques in liquid crystal flat panel displays.

2. Description of the Related Art

Flat panel displays or liquid crystal display (LCD) are popular display devices for conveying digital information, such as images, data and movies. The decreased weight and size of a flat panel display greatly increases its versatility over a cathode ray tube (CRT) display. High quality flat panel displays are typically back-lit. That is, a source of illumination is placed behind the LCD layers to facilitate visualization of the resultant image. Flat panel LCD units are used today in many applications including the computer industry where flat panel LCD units are an excellent display choice for lap-top computers and other portable electronic devices. However, because the technology of flat panel LCD units is improving, they are being used more and more in other mainstream applications, such as desktop computers, high-end graphics computers, and as television and other multi-media monitors.

Most computer LCD panels are back-lit with built-in fluorescent tubes above, beside or behind the LCD. A white diffusion panel behind the LCD redirects and scatters the light evenly to ensure a uniform display. This is known as a backlight. One of the commonly used fluorescent tubes in LCD panels is a tiny Cold Cathode Fluorescent Lamp (CCFL) for the backlight. It provides a bright white light source that can be diffused by the panel behind the LCD. In addition to providing ample light, CCFLs do not rise far above the ambient temperature. This makes them ideal for LCD panels since the light source is in close proximity to other components that could be ruined by excessive heat.

One amazing thing about these CCFLs is their incredible size. They are very thin and the board that drives a lamp is very small as well. However, it is not that hard to break them, which is why the LCD display may go dark if a laptop computer drops onto a hard floor but still works.

While everyone appears to be focused on the "zero radiation" advantage of the LCD technology, no one actually think what is behind the liquid crystals (which the "L" and "C" letters stand for). This happened to be the same fluorescent light technology which was not recommended for use as the only light source in offices.

A fluorescent light is most often a long straight glass tube that produces white light. Inside the glass tube there is a low-pressure mercury vapor. When ionized, mercury vapor emits ultraviolet light. Human eyes are not sensitive to ultraviolet light. The inside of a fluorescent light is coated with phosphor. Phosphor is a substance that can accept energy in one form and emit the energy in the form of visible light. For example, energy from a high-speed electron in a commonly seen TV tube, also referred to as cathode ray tube or CRT, is absorbed by the phosphors that make up the pixels. The light from a fluorescent tube is the light given off by the phosphor coating the inside of the tube. The phosphor fluoresces when energized, hence the name. It has been concluded that directly staring at a source of fluorescent light can be just as bad, if not worse. But there is no mentioning anywhere that that most LCD panels are actually a reflection of fluorescent lights and in many cases people spend considerable time in a day staring at such source.

Another one of the reasons that a fluorescent light is used as a backlight source is the inherent characteristics of being close to the sunlight. However, the spectrum of a typical fluorescent light is no close to that of the sunlight, often requiring compensation on white balance. No or improper adjustments on white balance would result in distortions of colors.

U.S. Pat. No. 6,657,607 proposes a solution of using multiple light sources for color balancing within a liquid crystal flat panel display unit. In particular, altering the brightness of two or more light sources, having differing color temperatures, is thus providing color balancing of a liquid crystal display unit within a given color temperature range. The patent, however, corrects only one aspect of the problems in a liquid crystal display that is backlit by fluorescent lighting by introducing additional lighting sources and polarization means.

There is, therefore, a need for a liquid crystal display that has steady backlighting, full spectrum of color reproduction and white balance, wherein the white balance may be readily adjusted to meet specific display requirements.

SUMMARY OF THE INVENTION

This section is for the purpose of summarizing some aspects of the present invention and to briefly introduce some preferred embodiments. Simplifications or omissions in this section as well as in the abstract and the title may be made to avoid obscuring the purpose of this section, the abstract and the title. Such simplifications or omissions are not intended to limit the scope of the present invention The invention pertains to enhanced backlight techniques in liquid crystal flat panel displays. According to one aspect of the present invention, the source to backlight a liquid crystal panel includes a plurality of light emitting diodes that are in at least three colors or color bins. The exact colors of the light emitting diodes are chosen to cover a full spectrum of color reproductions in the human visible spectrum that is much broader than that defined in a television standard (e.g., NTSC or PAL). As a result, a balanced white can be obtained and more vivid colors can be reproduced. In one embodiment, the light emitting diodes are in red, green and blue. In another embodiment, the light emitting diodes are in red, green 1, green 2 and blue. In still another embodiment, the light emitting diodes are in four or more predetermined colors that can optimally reproduce all colors in a crystal flat display (LCD) device that span more than those defined in with a television standard. According to another aspect of the present invention, a set of control signals are configured to ensure that the light emitting diodes provide desired backlighting to a LCD panel. One of the control signals adaptive to a scene or content of a scene causes the backlighting to change accordingly or drastically to create artistic effects required or desired in the scene.

The foregoing and other objects, features and advantages of the invention will become more apparent from the following detailed description of a preferred embodiment, which proceeds with reference to the accompanying drawings.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The invention pertains to enhanced backlight techniques in liquid crystal flat panel displays. According to one aspect of the present invention, the source to backlight a liquid crystal display (LCD) panel includes a plurality of light emitting diodes that are in at least three color groups. The exact color groups of the light emitting diodes are chosen to cover as a full spectrum of color reproductions as possible, which in general is broader than those defined in accordance with a television standard (e.g., NTSC or PAL), in addition to a balanced white. In one embodiment, the light emitting diodes are in red, green and blue. In another embodiment, the light emitting diodes are in red, green 1, green 2 and blue. In still another embodiment, the light emitting diodes are in four or more predetermined colors that can optimally reproduce all colors in a crystal flat display (LCD) device in accordance with a television standard. According to another aspect of the present invention, a set of control signals are configured to ensure that the light emitting diodes provide desired backlighting to a LCD panel. One of the control signals adaptive to a scene or content of a scene causes the backlighting to change accordingly or drastically to create artistic effects required or desired in the scene.

The detailed description of the invention is presented largely in terms of procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Figure 1:
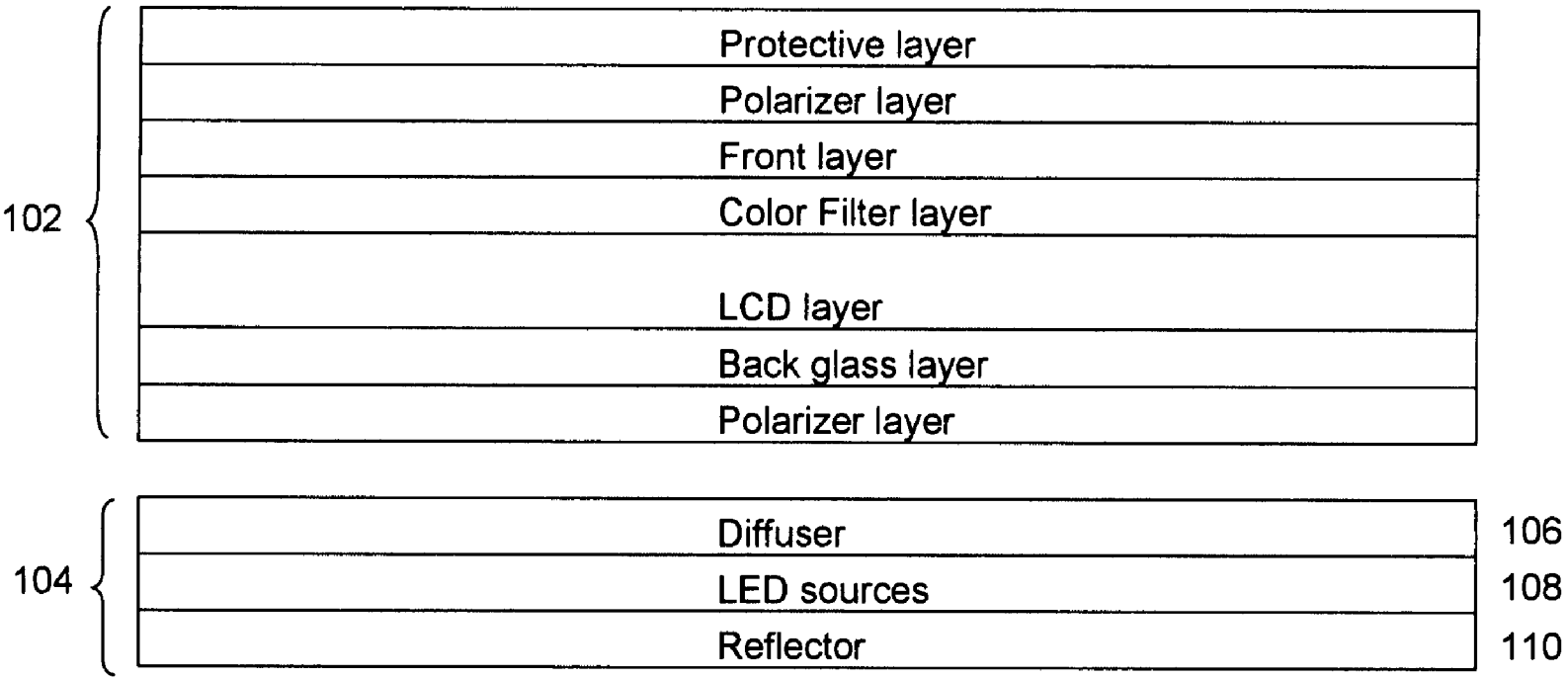
FIG. 1 shows a cross sectional view of an LCD device that employs an embodiment of the present invention.

Referring now to the drawings, in which like numerals refer to like parts throughout the several views. FIG. 1 shows a cross sectional view of an LCD device 100 that employs an embodiment of the present invention. The LCD device 100 includes an LCD panel 102 and a backlighting section 104. Depending on manufacturing process or specification configuration, the LCD panel 102 comprises at least some of a protective layer, a polarization layer, a front layer, a color filter layer, an LCD layer, a back glass layer and a polarizer layer. Exemplary LCD panels may be provided from Samsung in South Korea or Sharp in Japan.

Figure 2A:
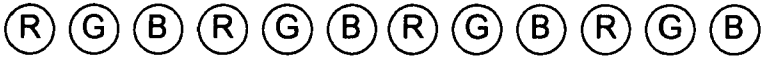
FIG. 2A shows three types of light-emitting diodes arranged in a line fashion.
Figure 2B:
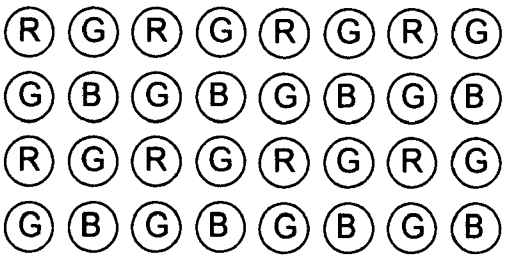
FIG. 2B shows four types of light-emitting diodes arranged in a matrix fashion.

The backlighting section 104 contemplated in the present invention provides steady backlighting, full spectrum of color reproduction and a balanced white color, wherein the white color may be readily adjusted to meet specific display requirements. According to one embodiment, the backlighting section 104 includes at least a diffuser 106, an LED source 108 and a reflector structure 110. Different from the prior art, the backlighting in the LCD device 100 is provided by a lighting source 108 that is based on a plurality of light emitting diodes (LEDs) that may be arranged, depending on implementation, in a line or a matrix fashion. To provide a balanced white color, in one embodiment, these light-emitting diodes are in at least three colors. The commonly used ones are in red, green or blue. FIG. 2A shows three types of light-emitting diodes arranged in a line fashion. With proper design of the reflector structure 110, even backlighting can be provided to the LCD panel 102. FIG. 2B shows four types of light-emitting diodes arranged in a matrix fashion. Other possible configurations of three or more types of light-emitting diodes are possible. As will be further described below, a second green LED is added in a group of red, green and blue light-emitting diodes to enhance the spectrum of the backlighting. The second green LED may be identical to or different from the first green LED in wavelength. With proper design of the reflector structure 110, even backlighting can be thus provided to the LCD panel 102.

Figure 3A:
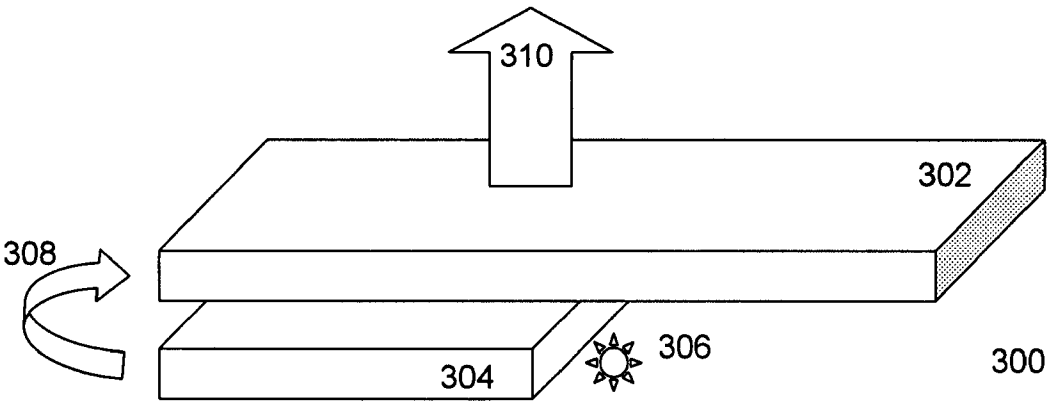
FIG. 3A shows an exemplary embodiment of the reflector structure.

FIG. 3A shows an exemplary embodiment 300 of the reflector structure 110. The structure includes a light pipe or guide 302, a light mixer 304, where the light mixer 304 mixes individual color lights from the light-emitting diodes and couples the mixed lights to the light guide 302 via a light reflector 308 that may be a prism or one or more mirrors. As a result, evenly distributed backlighting 310 is provided from the light guide 302.

Figure 3B:
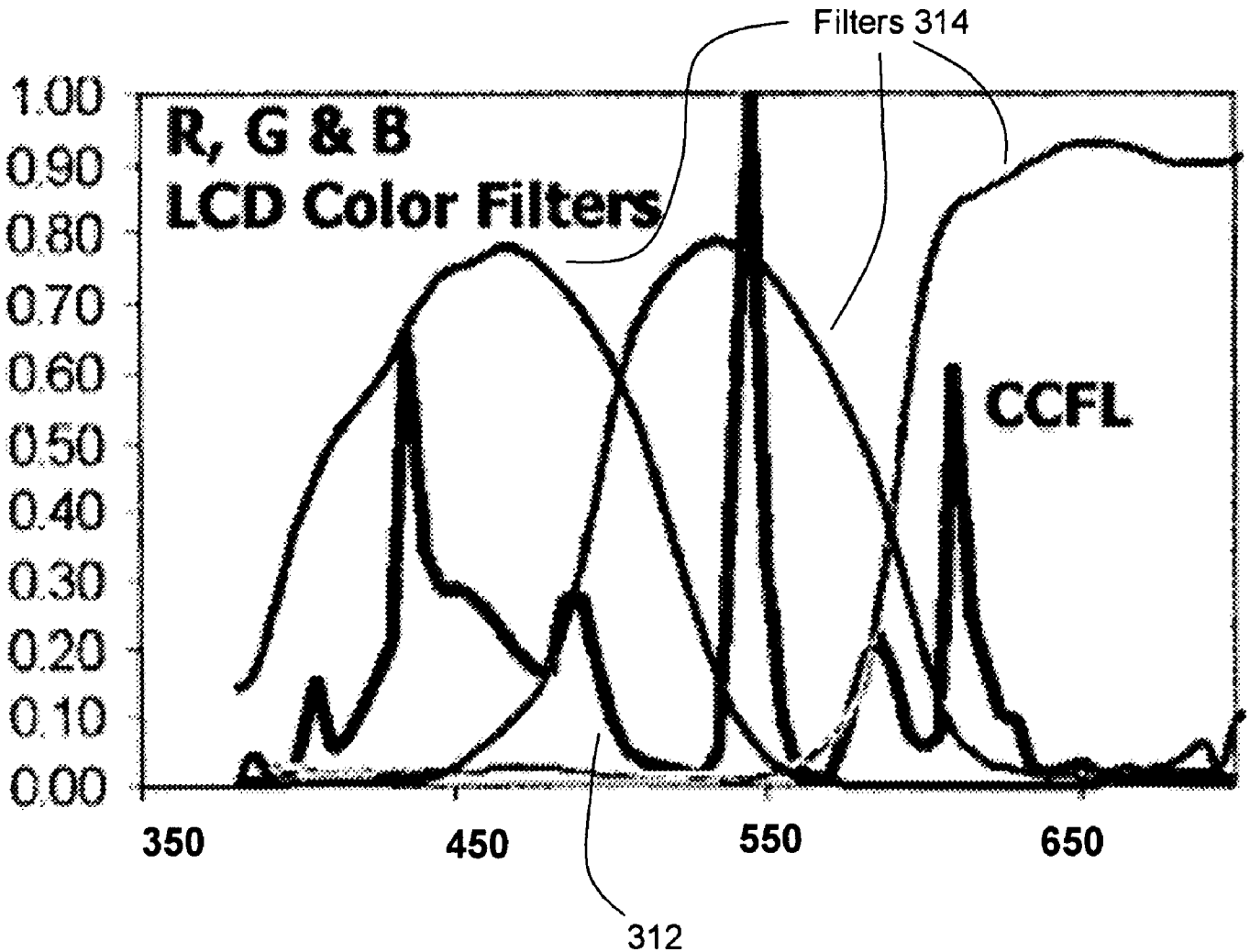
FIG. 3B shows a spectrum of lighting from a Cold Cathode Fluorescent Lamp (CCFL) superimposed with respective filter spectrums of optical filters commonly used in an LCD panel.
Figure 3C:
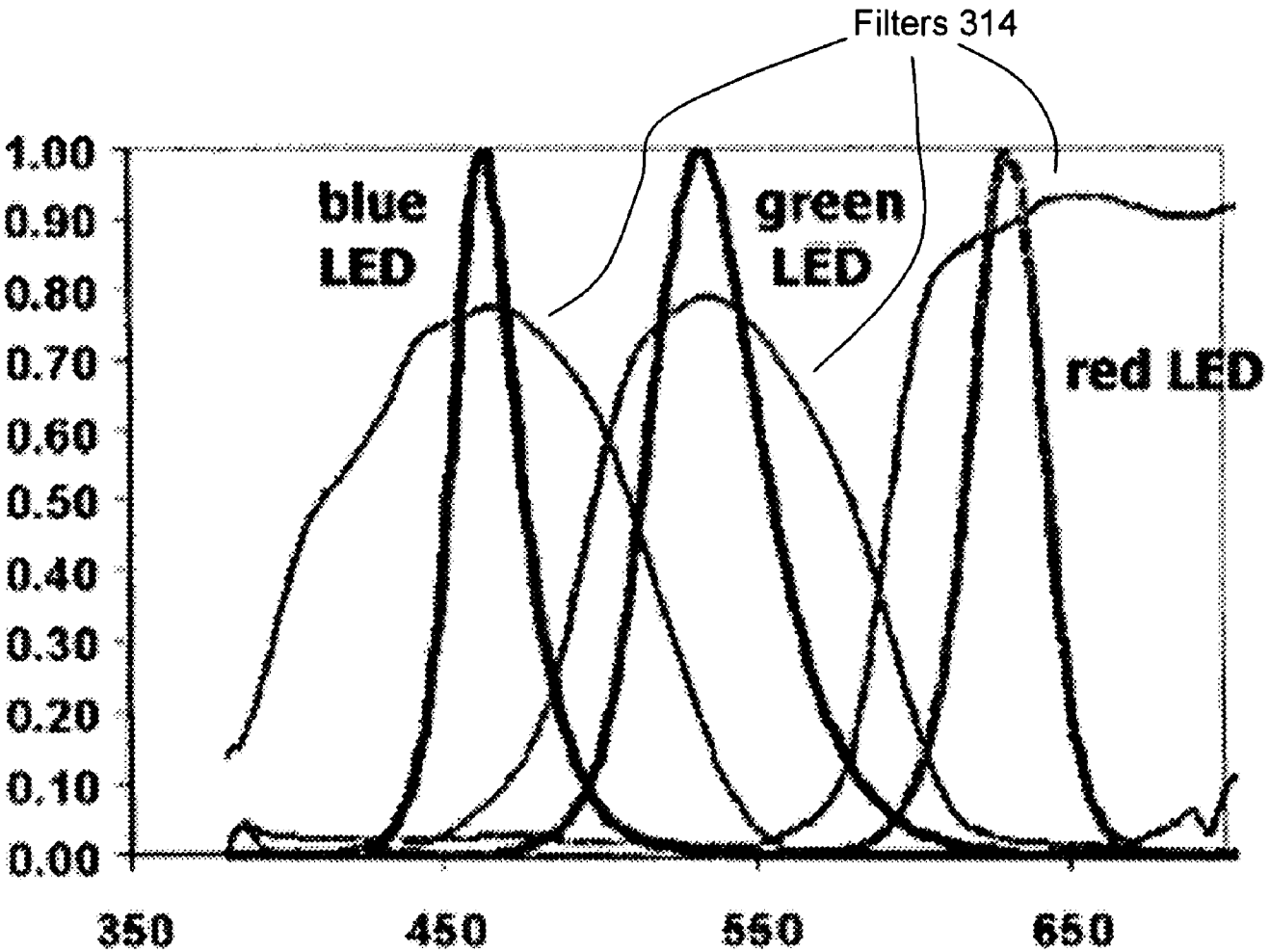
FIG. 3C shows three respective spectrums of lighting from each of three types of light-emitting diodes superimposed with respective filter spectrums of optical filters commonly used in an LCD panel.

FIG. 3B shows a spectrum 312 of lighting from a Cold Cathode Fluorescent Lamp (CCFL) with respective filter spectrums 314 of optical filters commonly used in an LCD panel. These filters are provided to produce a balanced while and reproduce colors correctly. However, the spectrum 312 shows that a CCFL has three narrow bands respectively concentrated on three different wavelengths. In other words, the lighting from a CCFL, as shown in FIG. 3B, does not have the necessary sources to produce a balanced white, leading to distortion of color reproductions despite the color filters. FIG. 3C shows three respective spectrums 320, 322, and 324 of lighting from each of three types of light-emitting diodes with respective filter spectrums 314 of optical filters commonly used in an LCD panel. Although the spectrums 320, 322, and 324 are wider than the spectrum 312, there are certain colors that would not be reproduced because certain wavelengths are not there or not strong enough to reproduce the colors (e.g., colors around 500 nm or 600 nm.

An advantage of light-emitting diodes is that they are available in almost any wavelength in the visible region. For categorization, the light emitting diodes come in color bins or groups, each bin or group concentrating on a color. As used herein, a color of a light emitting diode means one of the color bins or groups. With the flexibilities of the colors of the light emitting diodes, the spectrum design of a white color (white balance) by the light-emitting diodes may be more flexible than for traditional discharge lamps, where the available spectra depends on available phosphors and emissions from gas. In the case of multiple light-emitting diodes, a balanced white color or a chosen white color can be achieved by mixing lights from two, three or more light-emitting diodes of different peak wavelengths. The drawback in practice has been found that a white color is not necessarily balanced when the three types of light-emitting diodes, typically red, green and blue, are not carefully controlled.

Figure 4A:
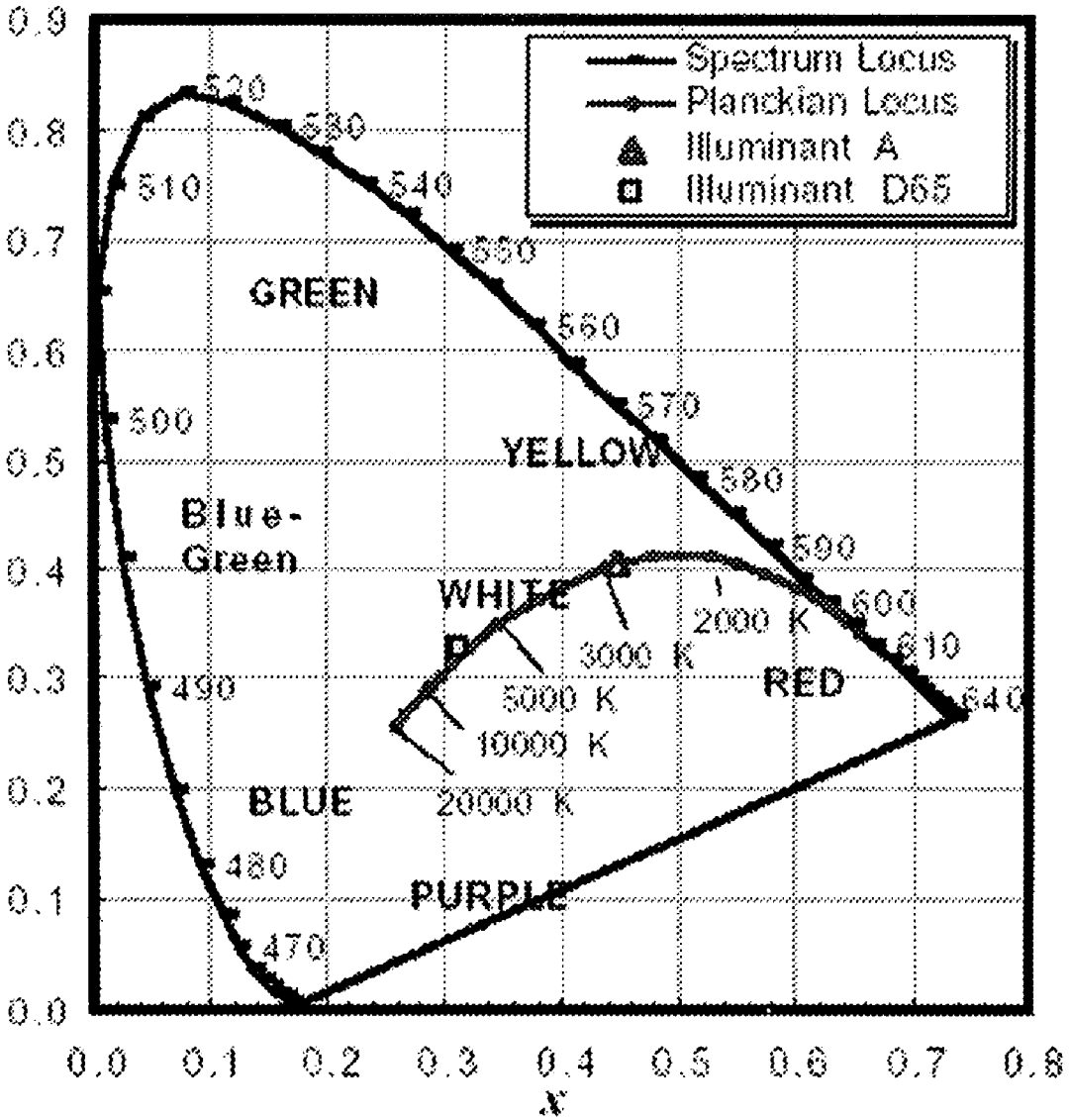
FIG. 4A shows the CIE 1931 (x, y) chromaticity diagram.

A correct or balanced white color is needed in order to show all the colors appropriately in accordance with a standard such as NTSC (National Television System Committee) and PAL (Phase Alternating Lines). In general, color of light is expressed by the CIE colorimetry system (CIE Publication 15.2-1986, Colorimetry, Second Edition). The spectrum of a given light is weighted by the XYZ color matching functions (CIE/ISO 10527-1991, CIE standard calorimetric observers). From the resultant three weighted integral values (called tristimulus values X, Y, Z), the chromaticity coordinate x, y is calculated by x=X/(X+Y+Z), y=Y/(X+Y+Z). Any color of light can be expressed by the chromaticity coordinate x, y on the CIE 1931 (x, y) chromaticity diagram, as shown in FIG. 4A. The boundaries of this horseshoe-shaped diagram are the plots of monochromatic light (called the spectrum locus). Also plotted near the center of the diagram is the so-called Planckian locus, which is the trace of the chromaticity coordinate of a blackbody at its temperature from 1000 K to 20000 K. The colors on the Planckian locus can be specified by the blackbody temperature in kelvin and is called color temperature. The colors around the Planckian locus from about 2500 K to 20000 K can be regarded as white, with 2500 K being reddish white and 20000 K being bluish white. The point labeled "Illuminant A" is the typical color of an incandescent lamp, and "Illuminant D65" the typical color of day light, as standardized by the CIE (CIE/ISO 10526-1991, CIE standard calorimetric illuminants). The color shift along the Planckian locus (warm to cool) is generously accepted or purposely varied for general lighting for desired mood.

Figure 4C:
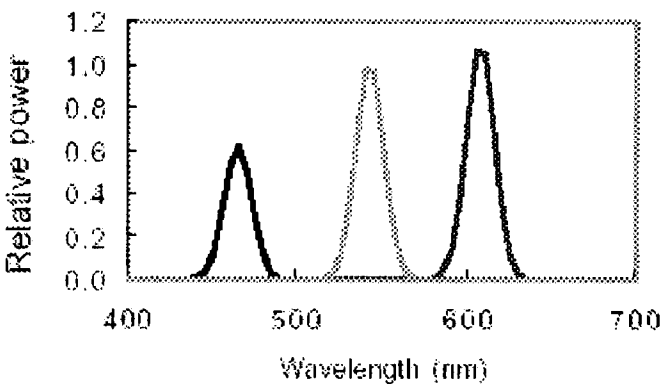
FIG. 4C shows relative power ration of three colored light emitting diodes with wavelengths of 459.7 nm, 542.4 nm, and 607.3 nm.
Figure 4B:
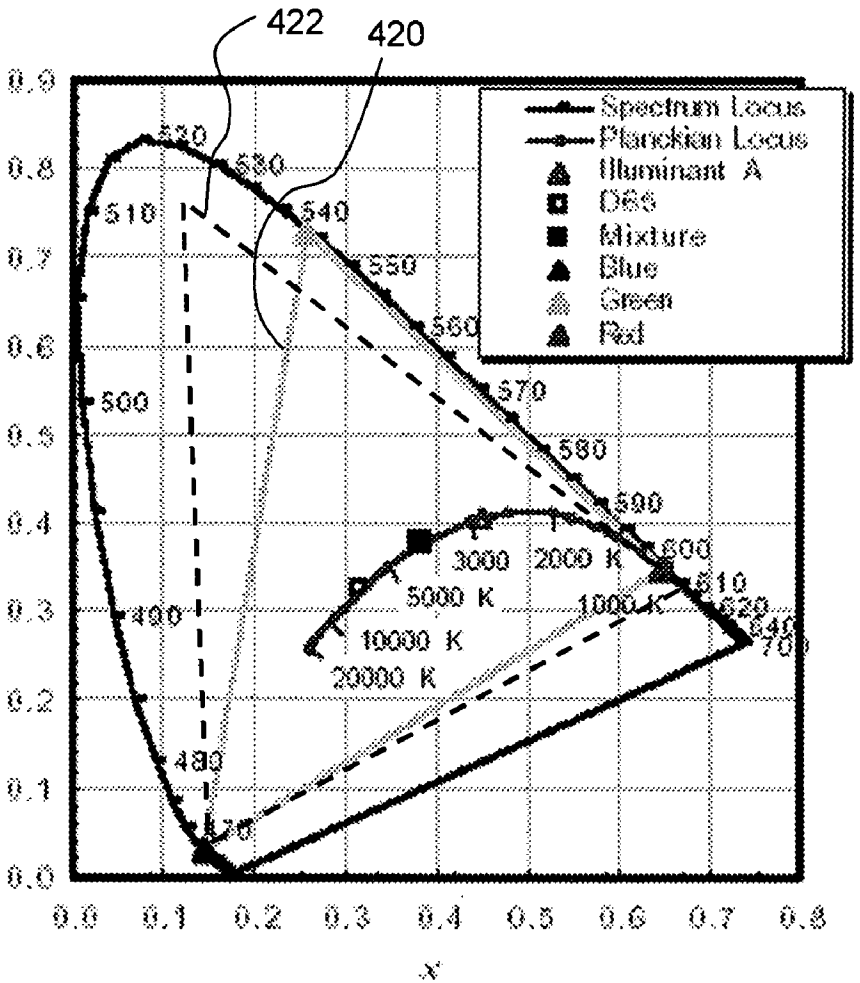
FIG. 4B shows the result of a simulation to produce a white color of 4000 K from a combination of three colored light emitting diodes with peak wavelengths of 459.7 nm, 542.4 nm, and 607.3 nm.

An important characteristic of the chromaticity diagram is that light stimuli on the diagram are additive. A mixture of two colors will produce a chromaticity coordinate falling on the line between the chromaticity coordinates of the two colors. A mixture of one more color into the already mixed color will produce a chromaticity coordinate falling on the line between the chromaticity coordinates of the third color and the already mixed color. FIG. 4B shows the result of a simulation to produce a white color of 4000 K from a combination of three colored light-emitting diodes with peak wavelengths of 459.7 nm, 542.4 nm, and 607.3 nm as shown FIG. 4C. The color triangle 420 reflects possible colors that the three colored light-emitting diodes can reproduce.

However, it is noticed that the triangle 420 does not coincide with the triangle 422 representing the colors in the standards of NTSC (National Television System Committee). In other words, not all colors specified in NTSC can be properly reproduced in a LCD device if only these three colored light-emitting diodes with peak wavelengths of 459.7 nm, 542.4 nm, and 607.3 nm are used.

According to one embodiment, another colored light-emitting diode is used to enhance the color triangle 420. In other words, instead of using a triplet of red, green and blue light-emitting diodes, a group of red, green1, green 2 and blue light-emitting diodes is used, where the wavelengths of green1 and green 2 are slightly different so that to complement one another so as to closely approximate the color triangle 420 to the color triangle 422.

According to another embodiment, a group of a number of red, green and blue light-emitting diodes is used. The wavelengths or spectrums of the red, green or blue light-emitting diodes are slightly different to complement one another. As a result, an enhanced color triangle based on multiple red, green and blue light-emitting diodes can be approximated closely enough to a desired color triangle that may be much bigger than the color triangle 422, as a result, more colors may be reproduced.

Figure 3D:
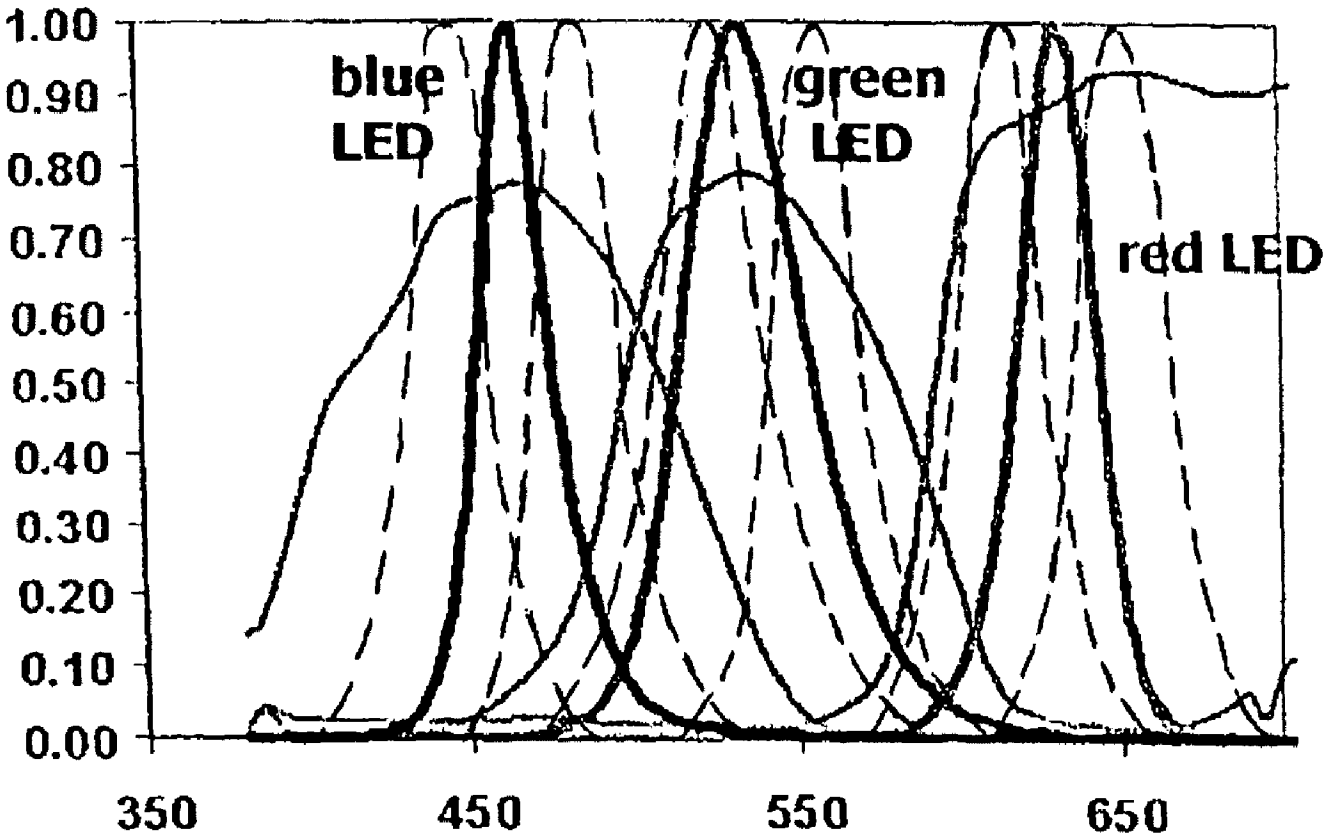
FIG. 3D shows exemplary spectrums of combining lights from a number of types of lighting emitting diodes superimposed with respective filter spectrums of optical filters commonly used in an LCD panel.

Without loss of generality, the above embodiment may be described in the following. It is assumed a backlighting group C to reproduce all colors defined by a desired triangle, a spectrum or the entire CIE chromaticity diagram includes a set or group of R(i), G(i), and B(i), each representing one colored light-emitting diode, where i=1, 2, . . . , N, thus:

$$C = \left\{ \sum_{i=1}^{N} R(\lambda_i), \sum_{i=1}^{M} G(\lambda_i), \sum_{i=1}^{K} B(\lambda_i), \right\}$$

where N, M and K are integers and may or may not be identical, A indicates a wavelength or a color. When a backlighting section employs a plurality of sets of the backlighting groups, an even and full color spectrum of backlighting can be achieved, resulting in vivid displays of all desired colors. FIG. 3D shows a group of eight light emitting diodes 320, 322, 324, 326, 328, 330, 332 and 334 to provide a full color spectrum. In order words, a plurality of such groups, if connected and controlled well, will provide perfect backlighting that enable full reproduction of all colors. In practice, the light emitting diodes may be from several color groups or bins, for example, there are a number of light emitting diodes from three blue color bins with a wavelength concentrated near 440 nm, 470 and 490 nm, from three green color bins with a wavelength concentrated near 520 nm, 530 nm and 550 nm, and from three red color bins with a wavelength concentrated near 610 nm, 630 nm and 650 nm. As a result, in comparison with FIG. 3C, these light emitting diodes provide a full spectrum of colors, with the color filters in an LCD panel, all colors can be vividly reproduced.

Figure 5:
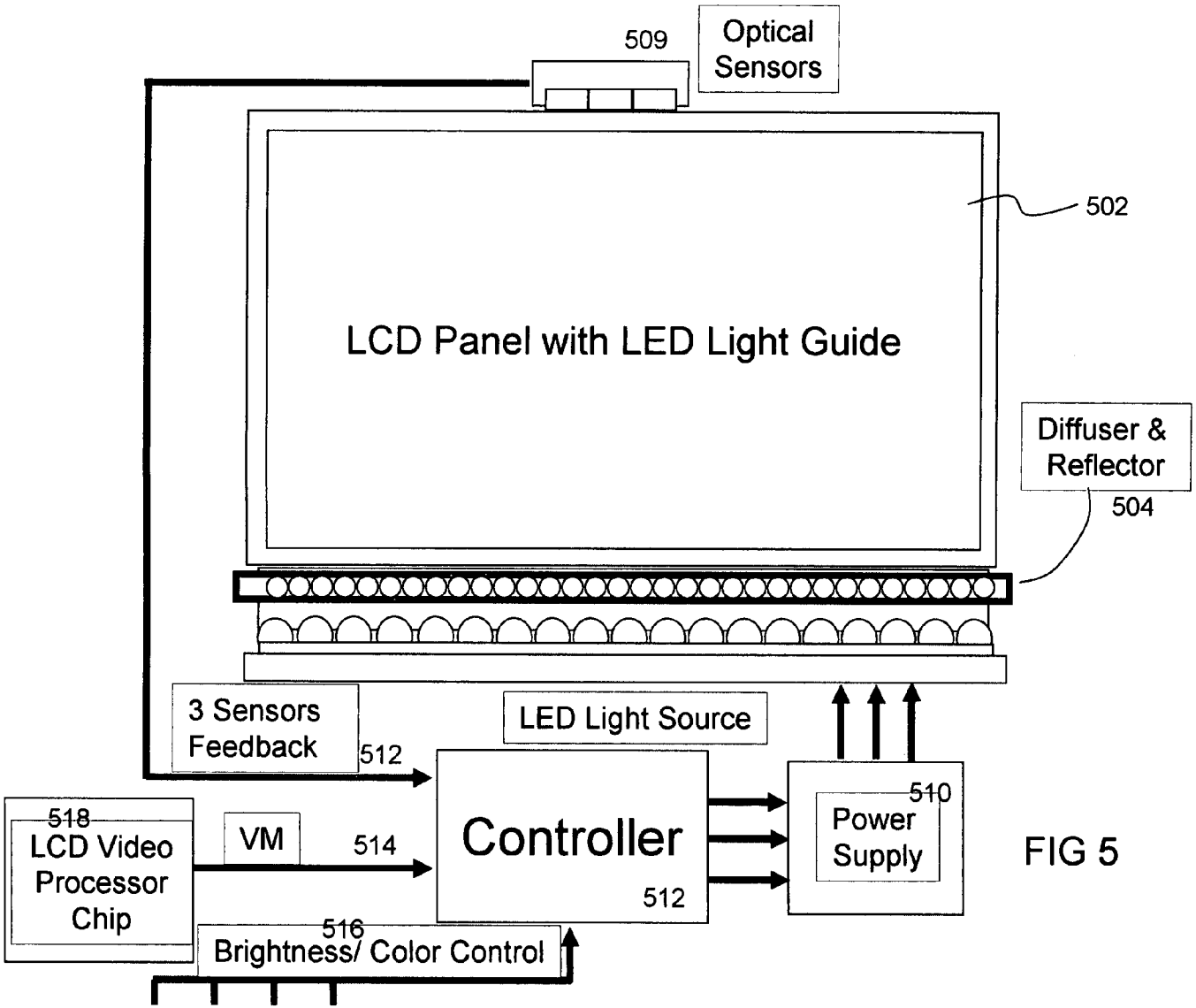
FIG. 5 shows a functional diagram of controlling a backlight section contemplated in the present invention.

FIG. 5 shows a functional diagram 500 of controlling a backlight section contemplated in the present invention. Behind an LCD panel 502 is an LED based backlight section that includes a group of diffuser(s) and reflector(s) 504 and an array of light-emitting diodes 506. The diffuser(s) and reflector(s) 504, together with other optical parts (not shown, e.g., reflectors), provide optical means to distribute lighting from the light-emitting diodes 506 evenly to LCD panel 502.

In the embodiment shown in FIG. 5, the light-emitting diodes 506 comprise at least three types of colored light-emitting diodes.

As described above, the light intensity of each of light-emitting diodes 506, once combined, affects the white balance. To ensure that a white color is balanced or at a desired color temperature, a controller 508 is provided to control the power supply 510 that drives the light-emitting diodes 506. The controller 508 receives at least three types control signals, sensor feedback signals 512, video control signal 514 and lighting control signals 516.

In one embodiment, the sensor feedback signals 512 are from sensors positioned to sense the resultant backlighting. For three types of colored light-emitting diodes in red, green and blue, three sensors 509 are provided to sense respectively the red, green and blue lighting and provide respective feedback signals to the controller 508. For example, it is desired to have a relative power ratio of three colored light-emitting diodes as R:G:B=0.9:1:08. For some reasons, the ratio is no longer holding, the three sensors 509 can immediately detect the difference and send the feedback signals to the controller 508 that determines what necessary adjustments need to be provided to the power supply 510 that in return causes the colored light-emitting diodes to keep the ratio. In another embodiment, there are more than three sensors for more types of light-emitting diodes. Optionally, one of the sensors is provided to sense brightness of the combined lighting provided by the light-emitting diodes. In case, the overall brightness exceeds a certain threshold, the brightness sensor can detect and reduce the power proportionally to drive the light-emitting diodes. Further, other sensors may be used to sense individual color sensation of each of the types of light emitting diodes or control the duty cycles of the light-emitting diodes to achieve desired backlighting for certain applications.

The video control signal 514 is a type of signal derived from a video processor configured to process video signals for display on the LCD device. Based on the contents, a desired backlighting may be provided. For example, when a scene requires a dark background in which case, the video control signal 514 can be sent to the controller 508 that cause the power supply 510 to completely shut down the backlighting, resulting in a complete darkness. Conversely, when a scene requires a background lighting to support the contents, the video control signal 514 can be configured to be sent to the controller 508 that causes the power supply 510 to control some or all of the light-emitting diodes to reach desired artistic effects. In one embodiment, there are a fixed number of levels of backlighting, each corresponding to a signal level of the video control signal 514. When there is an "unusual" background in a scene, resulting in a certain level of the video control signal 514, a corresponding backlighting is provided by controlling some or all of the light-emitting diodes to support such background so as to achieve or boost the desired artistic effects. In another application, the video control signal 514 in accordance with a sequence of scenes, especially in which there is a fast moving object, can be controlled in synchronization with the speed of the scenes so as to reduce the blurring effects in the displays of the object. For example, for a scene of 30 frames per second in which there is fast moving object, the video control signal 514 can cause the backlighting to be only on when a frame is displayed and off between two frames. In some cases, the duty cycles of each type of the light emitting diodes can be controlled.

The lighting control signals 516 are generated in accordance with a desired setting. For example, a certain TV manufacturer prefers to make some of its LCD TV sets to be a little reddish and others to be a little bluish. Accordingly, a 2600 K white (slightly reddish) or a 19500 K white (slightly bluish) can be produced with proper weights on the respective light-emitting diodes. In one embodiment, three types of colored light-emitting diodes are used, the relative power ratio of three colored light-emitting diodes as R:G:B=1:1:0.9 is used. The corresponding lighting control signals 516 are thus generated to be sent to the controller 508 that ensures the power supply 510 to control the three colored light-emitting diodes in accordance with the ratio. Depending on implementation, other control signals, such as a brightness control signal, may be included in the lighting control signals 516.

With the sensor feedback signals 512, the video control signal 514 and the lighting control signals 516, the backlighting in a LCD device can be provided in any desirable way and readily controlled. For example, a user may control the backlighting by specifying what color temperature is located in the CIE colorimetry system, and adjusting individually by circuitry or software any one of the color sets of the light-emitting diodes.

The invention may be implemented as an apparatus and a method, each yielding one or more of the following advantages and/or benefits. First, the operational lifespan of the light-emitting diodes is well beyond that of a fluorescent light. Second, in addition to being easily breakable, the fluorescent light sources often contain mercury while light-emitting diodes are all silicon devices, no direct impact on the environment. Third, light-emitting diodes can be easily controlled to achieve a desired white color while the fluorescent light source needs additional colored sources. In general, the white color is set by a manufacturer when fluorescent light sources are used. With the light emitting diodes as the backlighting, the white color can be readily set by a user or a device manufacturer (e.g., a TV manufacturer). Other advantages or benefits are apparent to those skilled in the art from the description herein.

The present invention has been described in sufficient detail with a certain degree of particularity. It is understood to those skilled in the art that the present disclosure of embodiments has been made by way of examples only and that numerous changes in the arrangement and combination of parts may be resorted without departing from the spirit and scope of the invention as claimed. For example, to achieve as much uniform as possible, the light-emitting diodes may be connected in parallel and series and driven by a constant power (e.g., current). Alternatively, the informality may be also achieved by arranging several sensors in a few locations behind an LCD panel to sense the intensity of the lighting and perform individual adjustment is necessary. While the embodiments discussed herein may appear to include some limitations as to the presentation of the information units, in terms of the format and arrangement, the invention has applicability well beyond such embodiment, which can be appreciated by those skilled in the art. Accordingly, the scope of the present invention is defined by the appended claims rather than the forgoing description of embodiments.

The present invention has been described in sufficient detail with a certain degree of particularity. It is understood to those skilled in the art that the present disclosure of embodiments has been made by way of examples only and that numerous changes in the arrangement and combination of parts may be resorted without departing from the spirit and scope of the invention as claimed. While the embodiments discussed herein may appear to include some limitations as to the presentation of the information units, in terms of the format and arrangement, the invention has applicability well beyond such embodiment, which can be appreciated by those skilled in the art. Accordingly, the scope of the present invention is defined by the appended claims rather than the forgoing description of embodiments.

We claim:

1. A liquid crystal display device comprising:

a liquid crystal display panel having a front viewing surface; and a backlighting section placed in parallel behind the liquid crystal display panel, wherein the backlighting section including:

a plurality of light emitting diodes in at least three color groups;

a controller controlling a power unit to energize the light emitting diodes in accordance with control signals;

a set of sensors sensing resultant lighting from the light emitting diodes, one of the control signals is fed back from the sensors such that the light emitting diodes provide consistent backlighting to the liquid crystal display panel.

2. The liquid crystal display device of claim 1, wherein colors from the at least three color groups are additive.

3. The liquid crystal display device of claim 2, wherein the light emitting diodes are generally in red, green and blue.

4. The liquid crystal display device of claim 1, wherein the light emitting diodes are in four additive colors.

5. The liquid crystal display device of claim 4, wherein the four additive colors are red, green 1, green 2 and blue, and wherein green 1 and green 2 are slightly different in wavelength such that a mixture of red, green 1, green 2 and blue in different weights reproduces substantially all colors in a spectrum defined by a standard.

6. The liquid crystal display device of claim 1, wherein the light emitting diodes are formed by a number of color groups, each group including $$\sum_{i=1}^{N} R(\lambda_i),\ \sum_{i=1}^{M} G(\lambda_i),\ \sum_{i=1}^{K} B(\lambda_i),$$

where N, M and K are integers, λ indicates a wavelength or a color.

7. The liquid crystal display device of claim 6, wherein N, M and K are different integers to ensure that colors in a predefined visible spectrum can be substantially reproduced.

8. The liquid crystal display device of claim 7, wherein the predefined visible spectrum is a superset of colors defined in accordance with a TV standard.

9. The liquid crystal display device of claim 1, wherein one of the control signals is from a video processor configured to process video signals to be displayed on the liquid crystal display device, the one of the control signals causes the light emitting diodes to generate the backlighting in accordance with a scene in the video signals.

10. The liquid crystal display device of claim 9, wherein the one of the control signals is selected from one of predefined levels in accordance with particular artistic effects to support the scene.

11. The liquid crystal display device of claim 1, wherein at least one of the control signals is configured to control the light emitting diodes in at least three colors in accordance with a relative power ratio.

12. The liquid crystal display device of claim 1, wherein at least one of the control signals is configured to control the light emitting diodes to generate a predetermined white color.

13. A liquid crystal display device comprising:

a liquid crystal display panel having a front viewing surface; and a backlighting section placed in parallel behind the liquid crystal display panel, wherein the backlighting section includes:

a plurality of light emitting diodes in at least four color groups;

a feedback loop including a controller controlling a power unit to energize the light emitting diodes in accordance with control signals, and a set of sensors sensing resultant lighting from the light emitting diodes;

wherein one of the control signals is fed back from the sensors such that the light emitting diodes provide consistent backlighting to the liquid crystal display panel;

wherein another one of the control signals is from a video processor configured to process video signals to be displayed on the liquid crystal display device, the another one of the control signals causes the light emitting diodes to generate the backlighting in accordance with a scene in the video signals so as to reach certain artistic effect according to the scene.

14. The liquid crystal display device of claim 13, wherein the another one of the control signals is selected from one of predefined levels to boost or enhance the artistic effect to support the scene.

15. The liquid crystal display device of claim 14, wherein the controller is configured to further receive at least a control signal configured to control the light emitting diodes in accordance with a relative power ratio.

16. The liquid crystal display device of claim 14, wherein still another one of the control signals is from at least one sensor configured to sense sensation or purity of a color from one of the color groups.

17. The liquid crystal display device of claim 13, wherein the light emitting diodes are formed by a number of color groups, each group including $$\sum_{i=1}^{N} R(\lambda_i),\ \sum_{i=1}^{M} G(\lambda_i),\ \sum_{i=1}^{K} B(\lambda_i),$$

where N, M and K are integers, λ indicates a wavelength or a color.

18. The liquid crystal display device of claim 17, wherein N, M and K are different integers to ensure that colors in a predefined visible spectrum can be substantially reproduced.

19. The liquid crystal display device of claim 18, wherein the predefined visible spectrum is a superset of colors defined in accordance with a TV standard.

* * * * *